US011598140B2

(12) United States Patent
Isono et al.

(10) Patent No.: US 11,598,140 B2
(45) Date of Patent: Mar. 7, 2023

(54) OPENING AND CLOSING BODY DRIVE DEVICE FOR VEHICLE

(71) Applicant: AISIN CORPORATION, Aichi (JP)

(72) Inventors: Taishi Isono, Kariya (JP); Shinji Kazama, Kariya (JP); Akinori Suzuki, Kariya (JP)

(73) Assignee: AISIN CORPORATION, Kariya (JP)

( * ) Notice: Subject to any disclaimer, the term of this patent is extended or adjusted under 35 U.S.C. 154(b) by 89 days.

(21) Appl. No.: 17/188,252

(22) Filed: Mar. 1, 2021

(65) Prior Publication Data

US 2021/0277700 A1 Sep. 9, 2021

(30) Foreign Application Priority Data

Mar. 6, 2020 (JP) ..... JP2020-038646

(51) Int. Cl.
*E05F 11/00* (2006.01)
*E05F 15/643* (2015.01)
*E05F 15/655* (2015.01)

(52) U.S. Cl.
CPC ..... *E05F 15/643* (2015.01); *E05F 15/655* (2015.01); *E05Y 2201/41* (2013.01);
(Continued)

(58) Field of Classification Search
CPC ..... E05F 15/643; E05F 15/655; E05F 15/646; E05Y 2201/41; E05Y 2201/422; E05Y 2201/652; E05Y 2900/531
(Continued)

(56) References Cited

U.S. PATENT DOCUMENTS 5,168,666 A * 12/1992 Koura ..... E05F 15/646 49/360
6,081,088 A * 6/2000 Ishihara ..... E05F 15/44 318/467
(Continued)

FOREIGN PATENT DOCUMENTS

CN 109757115 A * 5/2019 ..... B60J 5/04
EP 2933417 B1 * 11/2017 ..... E05F 15/635
(Continued)

OTHER PUBLICATIONS

U.S. Appl. No. 17/188,252, filed Mar. 1, 2021, Taishi Isono.
U.S. Appl. No. 17/188,267, filed Mar. 1, 2021, Taishi Isono.

*Primary Examiner* — Jerry E Redman
(74) *Attorney, Agent, or Firm* — Oblon, McClelland, Maier & Neustadt, L.L.P.

(57) ABSTRACT

An opening and closing body drive device for a vehicle includes a belt frame, plural driven pulleys, a belt wounded around the plural driven pulleys and fixed with a connector with respect to an opening and closing body, a drive unit provided with an output shaft including a rotary axis which extends in a different direction from a rotary axis of each of the plural driven pulleys, and a drive pulley connected to the output shaft of the drive unit. The drive pulley includes a rotary axis extending in the different direction from the rotary axis of each of the plural driven pulleys while extending in the same direction as the rotary axis of the output shaft. The drive pulley is wound with the belt which is twisted between the driven pulleys arranged at opposing sides of the drive pulley in a circumferential direction of the belt.

5 Claims, 7 Drawing Sheets

(52) U.S. Cl.
CPC ... *E05Y 2201/422* (2013.01); *E05Y 2201/652* (2013.01); *E05Y 2201/668* (2013.01); *E05Y 2900/531* (2013.01)

(58) Field of Classification Search
USPC ..... 49/360
See application file for complete search history.

(56) References Cited

U.S. PATENT DOCUMENTS 6,321,489 B1 * 11/2001 Murofushi ..... E05F 15/646 49/360
7,585,014 B2 * 9/2009 Nishimura ..... B60J 5/06 49/262
7,934,737 B2 * 5/2011 Okada ..... B60R 3/02 280/166
9,033,397 B2 * 5/2015 Sumiya ..... B60J 5/06 296/155
9,803,407 B2 * 10/2017 Seto ..... B60J 5/047
9,828,796 B2 * 11/2017 Seto ..... E05F 15/655
9,834,970 B2 * 12/2017 Seto ..... E05D 15/1042
2004/0221511 A1 * 11/2004 Rogers, Jr. ..... E05F 15/643 49/360
2010/0199567 A1 * 8/2010 Ishida ..... E05F 15/646 49/360
2016/0060942 A1 * 3/2016 Hansen ..... E05D 15/1042 49/352
2016/0201374 A1 * 7/2016 Seto ..... E05F 15/00 49/360
2016/0201375 A1 * 7/2016 Seto ..... E05D 15/1042 49/360
2016/0333626 A1 * 11/2016 Seto ..... E05F 15/646
2021/0277700 A1 * 9/2021 Isono ..... E05F 15/655
2021/0277701 A1 * 9/2021 Isono ..... B60J 5/06

FOREIGN PATENT DOCUMENTS

JP 2019-100081 A 6/2019
JP 2019-108740 A 7/2019

* cited by examiner

OPENING AND CLOSING BODY DRIVE DEVICE FOR VEHICLE

CROSS REFERENCE TO RELATED APPLICATIONS

This application is based on and claims priority under 35 U.S.C. § 119 to Japanese Patent Application 2020-038646, filed on Mar. 6, 2020, the entire content of which is incorporated herein by reference.

TECHNICAL FIELD

This disclosure generally relates to an opening and closing body drive device for a vehicle.

BACKGROUND DISCUSSION

A vehicle provided with a body including door opening portions at each side thereof, sliding doors opening and closing the door opening portions, and a sliding door drive device opening and closing the sliding doors is disclosed in JP2019-108740A (hereinafter referred to as Patent reference 1).

The sliding door drive device disclosed in Patent reference 1 includes a belt guide extending in the front-rear direction of the vehicle, a drive pulley and a guide pulley supported by the belt guide so as to be rotatable therewith, a belt wound about the drive pulley and the guide pulley, a motor driving the drive pulley, a transmission mechanism transmitting power of the motor to the drive pulley, and a belt connector connecting the belt and the sliding door. The sliding door drive device opens and closes the sliding door by rotating the belt to move the belt connector forward and rearward.

The sliding door drive device disclosed in Patent reference 1 requires the transmission mechanism transmitting power of the motor to the drive pulley while changing the orientation of rotary shaft of the motor since a rotary axis of an output shaft of the motor and a rotary axis of the drive pulley intersect with to each other. This is also common to an opening and closing body drive device for a vehicle which opens and closes an opening and closing body of the vehicle other than the sliding doors.

A need thus exists for an opening and closing body drive device for a vehicle which is not susceptible to the drawback mentioned above.

SUMMARY

According to an aspect of the disclosure, an opening and closing body drive device for a vehicle opening and closing an opening and closing body of the vehicle includes a belt frame extending in a moving direction of the opening and closing body, plural driven pulleys arranged spaced apart from each other in a longitudinal direction of the belt frame, a belt wounded around the plural driven pulleys and fixed with a connector with respect to the opening and closing body, a drive unit provided with an output shaft including a rotary axis which extends in a different direction from a rotary axis of each of the plural driven pulleys, and a drive pulley connected to the output shaft of the drive unit and configured to drive the belt. The drive pulley includes a rotary axis extending in the different direction from the rotary axis of each of the plural the driven pulleys while extending in the same direction as the rotary axis of the output shaft. The drive pulley is wound with the belt which is twisted between the driven pulleys arranged at opposing sides of the drive pulley in a circumferential direction of the belt.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An embodiment of a vehicle including an opening and closing body drive device for a vehicle will hereunder be explained. The vehicle width direction will hereunder be also referred to as the width direction, the vehicle front-rear direction is also referred to as the front-rear direction, and the vehicle upper-lower direction is also referred to as the upper-lower direction. An axis extending in the width direction is illustrated as an X axis, an axis extending in the front-rear direction is illustrated as a Y axis, and an axis extending in the upper-lower direction is illustrated as a Z axis.

Figure 1:
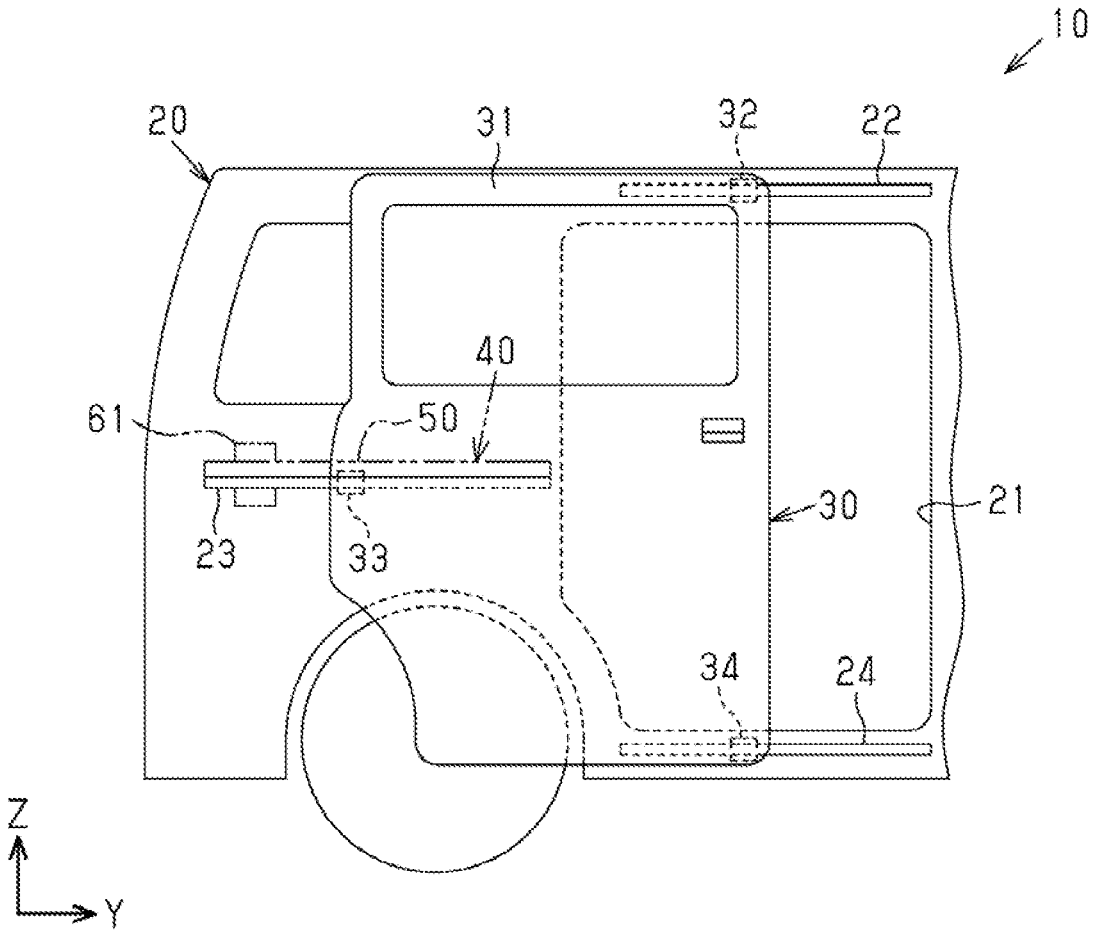
FIG. 1 is a side view of a vehicle provided with a sliding door drive device according to an embodiment disclosed here.

As shown in FIG. 1, a vehicle 10 includes a body 20 having a door opening portion 21 at a side thereof, a sliding door 30 serving as an example of an opening and closing body, a door drive device 40 serving as an example of the opening and closing body drive device for the vehicle.

The body 20 includes an upper rail 22 arranged at an upward of the door opening portion 21, a center rail 23 arranged at a rear of the door opening portion 21, and a lower rail 24 arranged at a downward of the sliding door 30. The upper rail 22, the center rail 23, and the lower rail 24 are fixed at the side of the body 20. The upper rail 22 is arranged above the center rail 23 and the lower rail 24, and the center rail 23 is arranged between the upper rail 22 and the lower rail 24 in the upper-lower direction.

Figure 2:
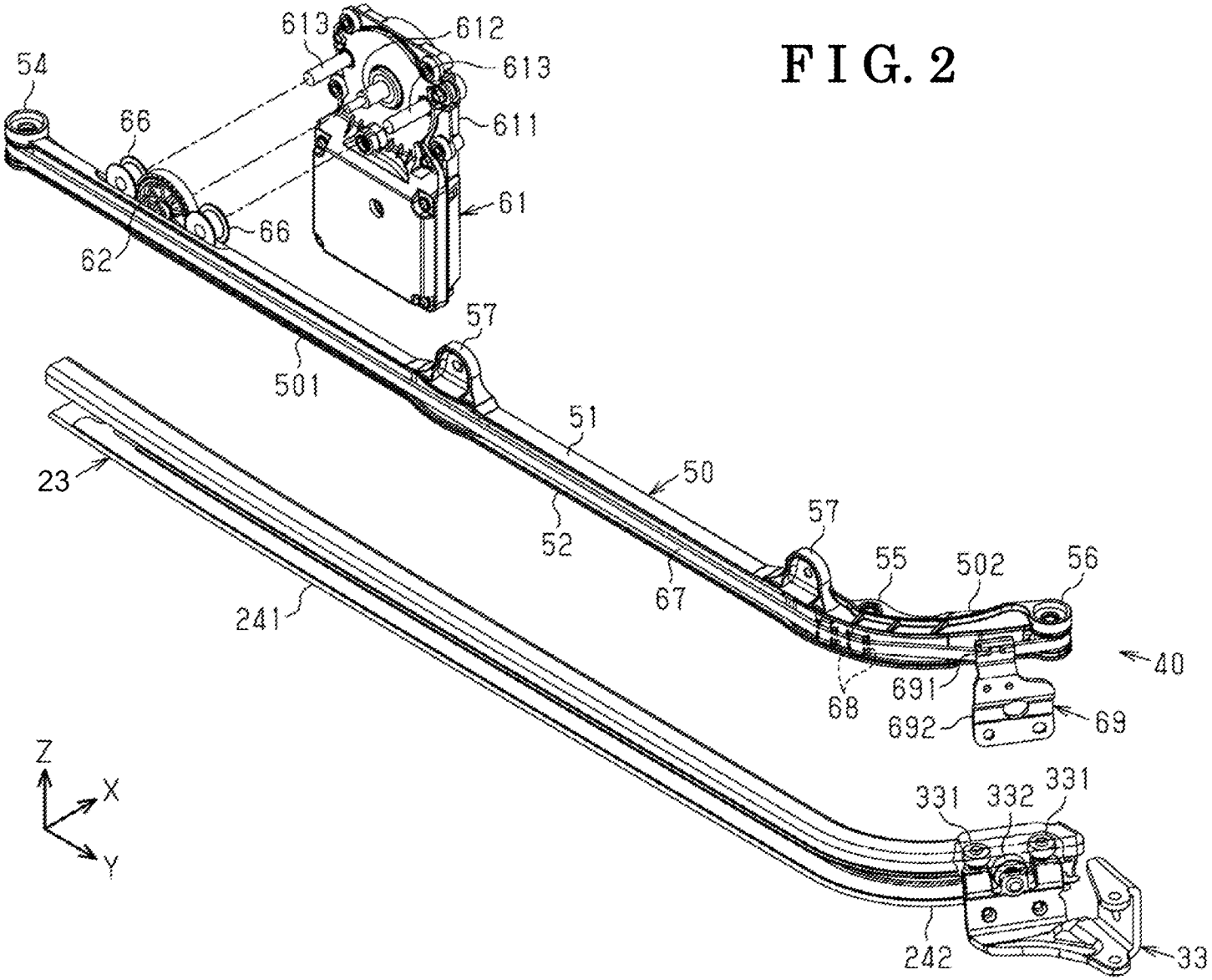
FIG. 2 is a perspective view of the sliding door drive device of the embodiment.

As shown in FIG. 2, the center rail 23 includes a first rail 241 extending frontward, and a second rail 242 extending inward in the width direction as extending frontward from a front end of the first rail 241, that is, the second rail 242 being tapered as extending frontward from the front end of the first rail 241. That is, the longitudinal direction of the first rail 241 and the longitudinal direction of the second rail 242 intersect with each other. The second rail 242 is curved or bent with respect to the first rail 241, resulting in that the sliding door 30 may be opened and closed without coming into contact with the body 20. The upper rail 22 and the lower rail 24 also include the same shape as that of the center rail 23.

As shown in FIG. 1, the sliding door 30 includes a door body 31, an upper roller unit 32, a center roller unit 33, and a lower roller unit 34. The door body 31 includes a dimension which is in accordance with the door opening portion 21. The upper roller unit 32 is arranged at an upward of the door body 31. The center roller unit 33 is at a rearward of the door body 31. The lower roller unit 34 is arranged at a downward of the door body 31.

The upper roller unit 32 and the lower roller unit 34 are arranged in the vicinity of the front end of the door body 31. The center roller unit 33 is arranged in the vicinity of the rear end of the door body 31. The upper roller unit 32, the center roller unit 33 and the lower roller unit 34 are connected to the door body 31 to be rotatable about the axis thereof extending the upper-lower direction.

As shown in FIG. 2, the center roller unit 33 includes a pair of guide rollers 331 inhibiting the sliding door 30 from being deformed mainly in the width direction and a road roller 332 supporting the weight of the sliding door 30. The pair of guide rollers 331 includes a rotary axis extending in the upper-lower direction. The road roller 332 includes a rotary axis which is orthogonal to the axis of the guide roller 331 and the longitudinal direction of the center rail 23. The pair of guide rollers 331 and the road roller 332 rotate in a state of being in contact with the center rail 23, and the center roller unit 33 may move in the longitudinal direction of the center rail 23. The upper roller unit 32 and the lower roller unit 34 include the same configuration as that of the center roller unit 33.

The sliding door 30 is open and closed between a fully-closed position where the door opening portion 21 is fully closed and a fully-open position where the door opening portion 21 is fully opened by the upper roller unit 32, the center roller unit 33 and the lower unit 34 which move with respect to the upper rail 22 and the center rail 23, and the lower rail 24, respectively.

Figure 3:
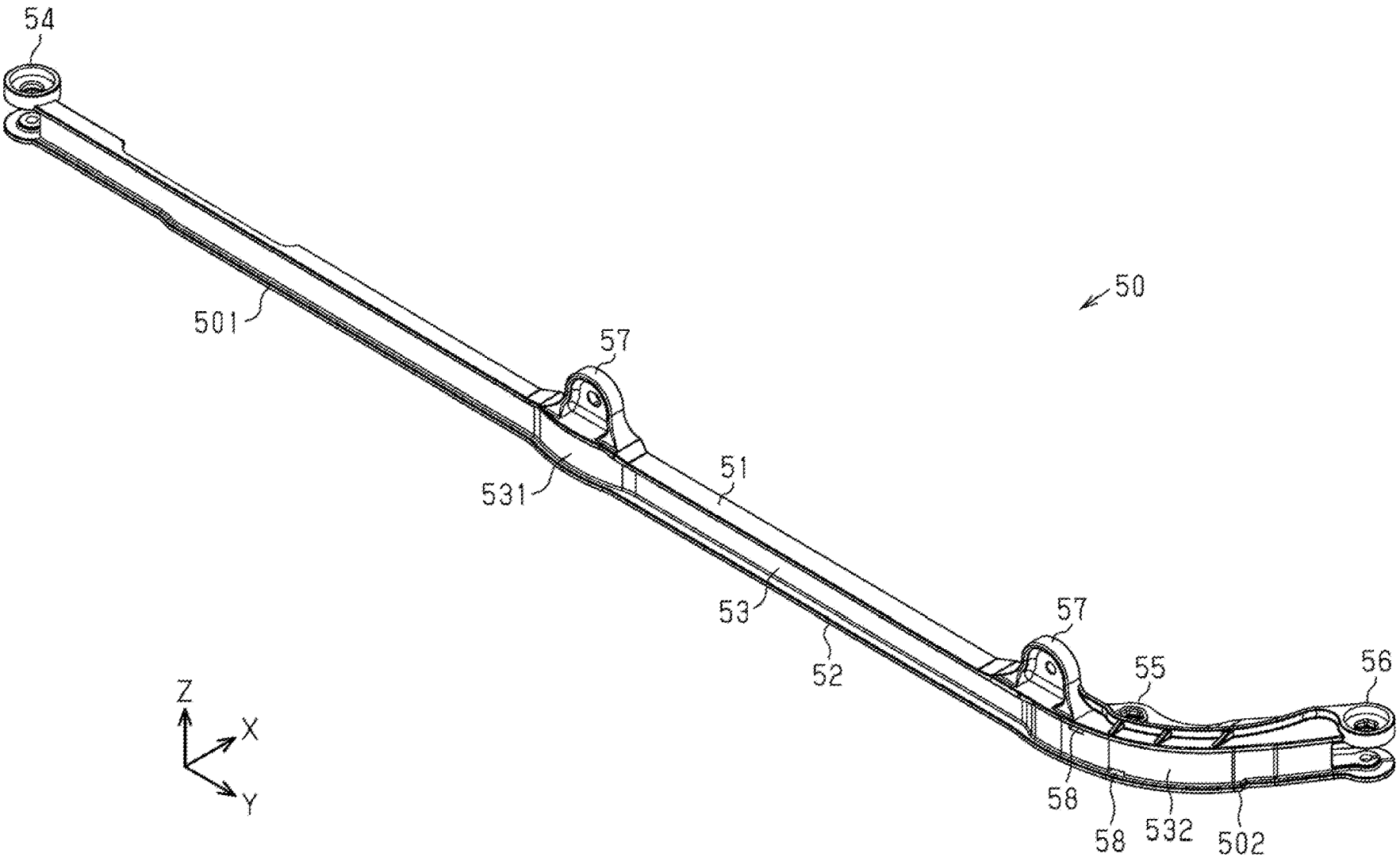
FIG. 3 is a perspective view of a belt frame of the sliding door drive device.
Figure 4:
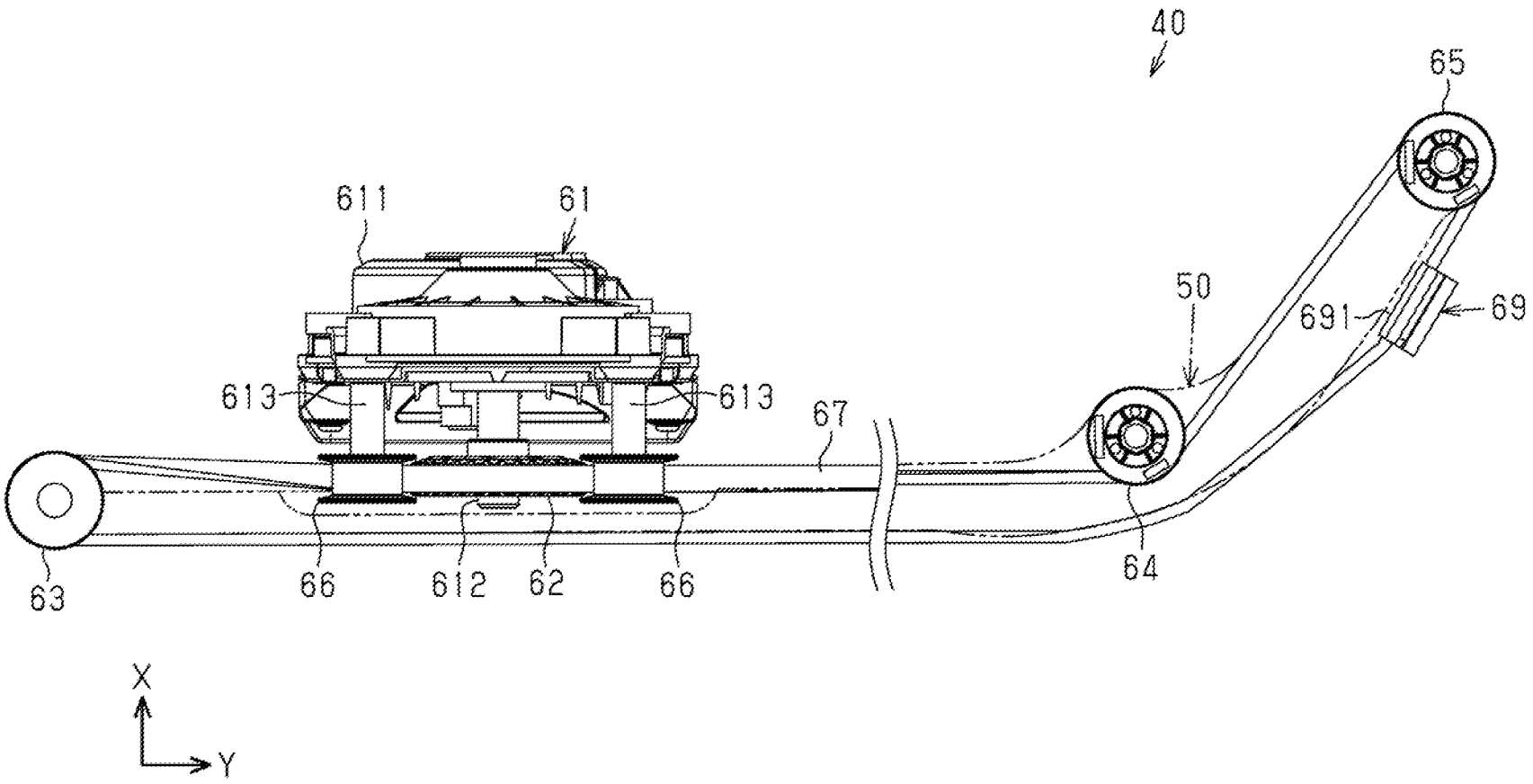
FIG. 4 is a plan view of the sliding door drive device.
Figure 5:
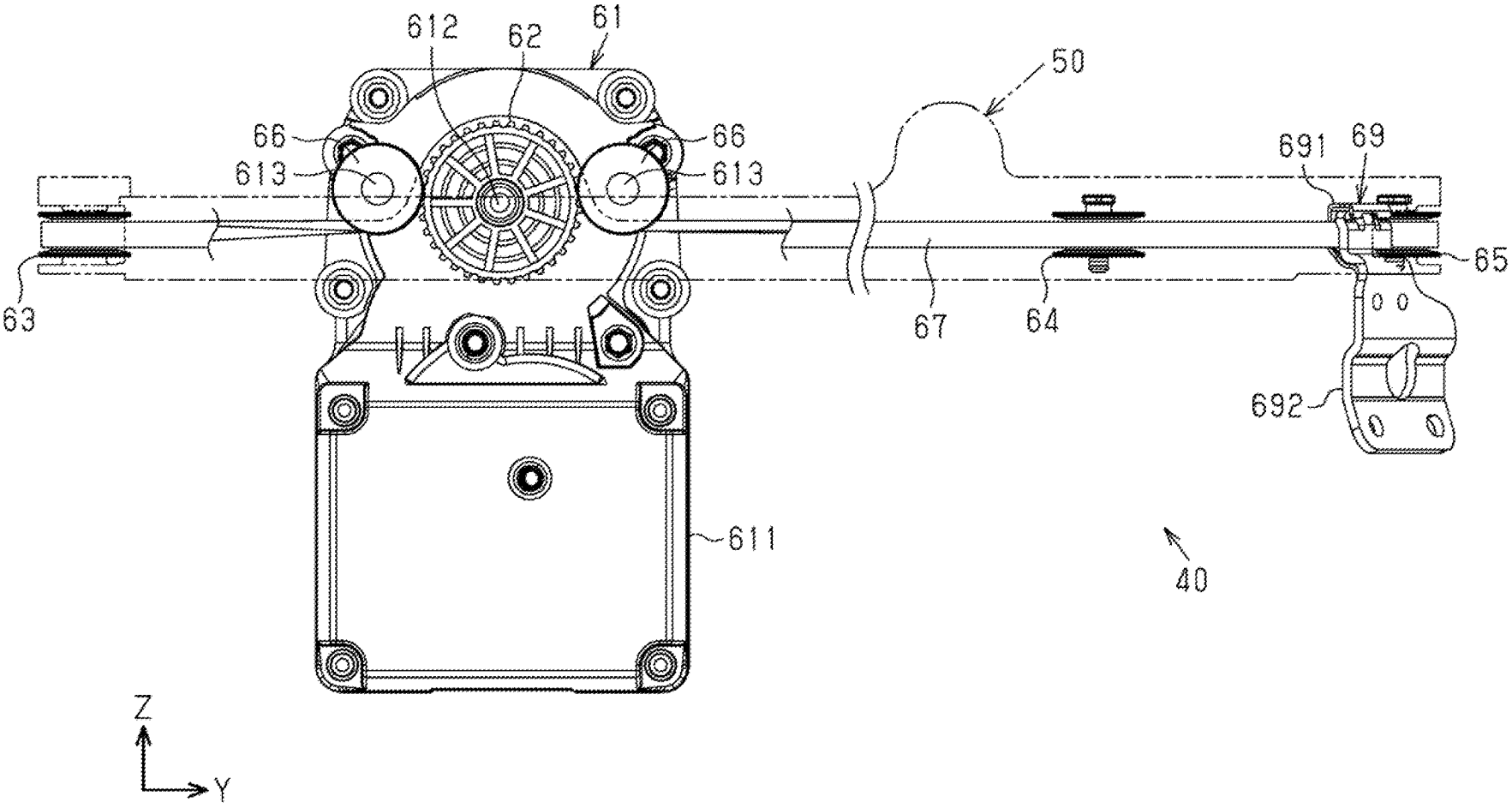
FIG. 5 is a side view of the sliding door drive device.

Next, a door drive device 40 (i.e., serving as an opening and closing body drive device for a vehicle) will be explained. As shown in FIGS. 2 and 3, the door drive device 40 includes a belt frame 50, a drive unit 61, and a drive pulley 62. The belt frame 50 extends along the center rail 23. The drive unit 61 serves as a drive source of the sliding door 30. The drive pulley 62 is arranged in the vicinity of the rear end of the belt frame 50. As shown in FIGS. 4 and 5, the door drive device 40 includes plural driven pulleys 63, 64, 65 arranged spaced apart from each other in the longitudinal direction of the belt frame 50. As shown in FIG. 2, the door drive device 40 includes a pair of press pulleys (i.e., serving as a first press pulley and a second press pulley) 66, a belt 67, plural biasing members 68, and a connector 69. The pair of press pulleys 66 are arranged in the vicinity of the drive pulley 62. The drive pulley 62, the plural driven pulleys 63 to 65, and the pair of press pulleys 66 are wound by the belt 67. The plural biasing members 68 press the belt 67. The connector 69 connects the sliding door 30 and the belt 67.

As shown in FIG. 3, the belt frame 50 includes a top wall 51, a bottom wall 52, and a guide wall 53 extending in the longitudinal direction thereof. The belt frame 50 further includes plural pulley support portions 54, 55, 56 supporting the plural driven pulleys 63, 64, 65 to be rotatable therewith, respectively, and plural fixed portions 57 fixed to the body 20. The belt frame 50 also includes plural insertion holes 58 into which the plural biasing members 68 are inserted.

As shown in FIG. 2, the belt frame 50 extends in the moving direction of the sliding door 30 and is formed in substantially the same shape as the center rail 23. That is, the belt frame 50 includes a part extending frontward, and a part extending inward in the width direction as extending frontward. Hereinafter, the former is also referred to as a first frame 501, and the latter is also referred to as a second frame 502. The first frame 501 corresponds to a part extending in the direction supporting the first rail 241 of the center rail 23, and the second frame 502 corresponds to a part extending in the direction supporting the second rail 242 of the center rail 23. The belt frame 50 is made by, for example, a resin molding process.

The top wall 51, the bottom wall 52, and the guide wall 53 are formed in a planar shape. The guide wall 53 connects the top wall 51 and the bottom wall 52 in the upper-lower direction. Thus, the belt frame 50 includes a substantially I cross-sectional shape orthogonal to the longitudinal direction. As shown in FIG. 3, the guide wall 53 includes first and second protrusions 531, 532 protruding in an arc shape at a surface facing outward in the width direction. The first protrusion 531 is arranged at middle of the first frame 501 in the longitudinal direction, and the second protrusion 532 is arranged at a connection part of the first frame 501 and the second frame 502, in other words, the second protrusion 532 lies between the first frame 501 and the second frame 502.

The first pulley support portion 54 is arranged at a rear end portion of the belt frame 50. The second pulley support portion 55 is arranged in the vicinity of the second protrusion 532 of the belt frame 50. The third pulley support portion 56 is arranged at a front end portion of the belt frame 50. The first pulley support portion 54, the second pulley support portion 55, and the third pulley support portion 56 each includes a shaft hole having an axial direction in the upper-lower axial direction.

The plural fixed portions 57 protrude upward from the top wall 51. It is favorable that the plural fixed portions 57 each includes a through hole into which a fastener such as a screw penetrates. The belt frame 50 is attached to a body panel of the body 20 from outward of the vehicle 10 via the plural fixed portions 57.

Plural through holes 58 are equally spaced from each other in the longitudinal direction of the belt frame 50 at positions in the vicinity of the rear end of the second frame 502. The through hole 58 which is arranged in the vicinity of the front end of the second frame 502 is arranged in the vicinity of the bottom end of the guide wall 53. The through hole 58 arranged in the vicinity of the rear end of the second frame 502 is arranged in the vicinity of the top end of the guide wall 53.

As shown in FIGS. 4 and 5, the drive unit 61 includes a body 611 including a substantially cubic shape, an output shaft 612 extending from the body 611, and a pair of support shafts 613 extending from the body 611. Assuming that the body includes three sides which are a longest side referred to as a first side, a next-longest side referred to as a second side, and a shortest side referred to as a third side, the body 611 is mounted on the body 20 in a state where the first side extends in a vertical direction, the second side extends in the front-rear direction, and the third side extends in the width direction. Thus, it is hard for the drive unit 61 to protrude toward a vehicle compartment in the width direction. Unlike the belt frame 50, the drive unit 61 is mounted on the body panel of the vehicle 20 from inward of the vehicle 10. Thus, in the embodiment, the belt frame 50 and the drive unit 61 are mounted on the body 20 such that the positional relative relationship between the belt frame 50 and the drive unit 61 is fixed.

The body panel of the body 20 is required to include through holes into which the output shaft 612 and the pair of support shafts 613 penetrate. In the embodiment, the dimension of the through hole may be decreased because only the output shaft 612 and the pair of support shafts 613 are penetrated outward of the vehicle 10. That is, a sealing structure between the through holes and the output shaft 612 and the pair of the support shafts 613 may be simply provided.

A motor and a decelerator are accommodated in the body 611. That is, the torque outputted by the output shaft 612 corresponds to the torque outputted by the motor and increased by the decelerator. The rotary axis of the output shaft 612 and the rotary axis of the pair of support shafts 613 are parallel to one another. The output shaft 612 is arranged between the pair of support shafts 613.

The drive pulley 62 corresponds to a timing pulley including a teeth portion. The drive pulley 62 is connected to the output shaft 612 of the drive unit 61. That is, the rotary axis of the drive pulley 62 extends in the width direction and extends in the same direction of the rotary axis of the output shaft 612 of the drive unit 61. Specifically, the rotary axis of the drive pulley 62 accords with or corresponds to the rotary axis of the output shaft 612 of the drive unit 61.

The first driven pulley 63 and the third driven pulley 65 each corresponds to a timing pulley including a teeth portion, and the second driven pulley 64 does not include a teeth portion. The second driven pulley 64 may also be referred to as a bend pulley changing a moving direction of the belt 67. The first driven pulley 63, the second driven pulley 64, and the third driven pulley 65 are rotatably supported by the first pulley support portion 54, the second pulley support portion 55, and the third pulley support portion 56 of the belt frame 50, respectively.

As a result, the axes of the first driven pulley 63, the second driven pulley 64, and the third driven pulley 65, in other words, the axial direction of the first driven pulley 63, the second driven pulley 64, and the third driven pulley 65, extend in the upper-lower direction. That is, the rotary axes of the first driven pulley 63, the second driven pulley 64, and the third driven pulley 65 intersect with the rotary axis of the driven pulley 62, in other words, the rotary axis of the output shaft 612. That is, the rotary axes of the first driven pulley 63, the second driven pulley 64, and the third driven pulley 65 are orthogonal to the rotary axis of the drive pulley 62.

The pair of press pulleys 66 corresponds to a pulley which does not include a teeth portion, and presses the belt 67 against the drive pulley 62. The pair of press pulleys 66 may also be referred to as a snub pulley increasing a contact angle or a total arc of contact of the belt 67 with respect to the drive pulley 62. The pair of press pulleys 6 are rotatably supported by the pair of support shafts 613 of the body 611. That is, the rotary axis of the pair of press pulleys 66 extends in the width direction, and in the same direction as the rotary axis of the drive pulley 62.

The belt 67 corresponds to a belt with teeth, the belt including a teeth portion, at an inner side thereof. The belt 67 is wound around the drive pulley 62, the plural driven pulleys and the pair of press pulleys 66 in a state of surrounding the guide wall 53 of the belt frame 50. It is favorable that the belt 67 includes an appropriate deflection in a state of being wound around the drive pulley 62, the plural driven pulleys and the pair of press pulleys 66.

An inner surface of a part of the belt 67 which is wound around the drive pulley 2 and the pair of press pulleys 66 does not face the guide wall 53 of the belt frame 50. An inner surface of a part of the belt 67 which is wound around the plural driven pulleys 63 to 65 faces the guide wall 53 of the belt frame 50. That is, the part of the belt 67 wound around the drive pulley 62 and the pair of press pulleys 66 is twisted by a substantially 90 degrees about the axis extending in the circumferential direction of the belt 67 with respect to the part of the belt 68 wound around the plural driven pulleys 63 to 65.

Hereinafter, the twisted part of the belt 67 is referred to a state where the inner surface of the belt 67 does not face the guide wall 53 of the belt frame 50, and the untwisted part of the belt 67 is referred to as a state where the inner surface of the belt 67 faces the guide wall 53 of the belt frame 50. That is, the part of the belt 67 between the first driven pulley 63 and the second driven pulley 64 in the circumferential direction of the belt 67 is twisted, and the part of the belt 67 between the second driven pulley 64 and the third driven pulley 65, and the part of the belt 67 arranged between the third driven pulley 65 and the first driven pulley 63 in the circumferential direction of the belt 67 is not twisted.

Figure 6:
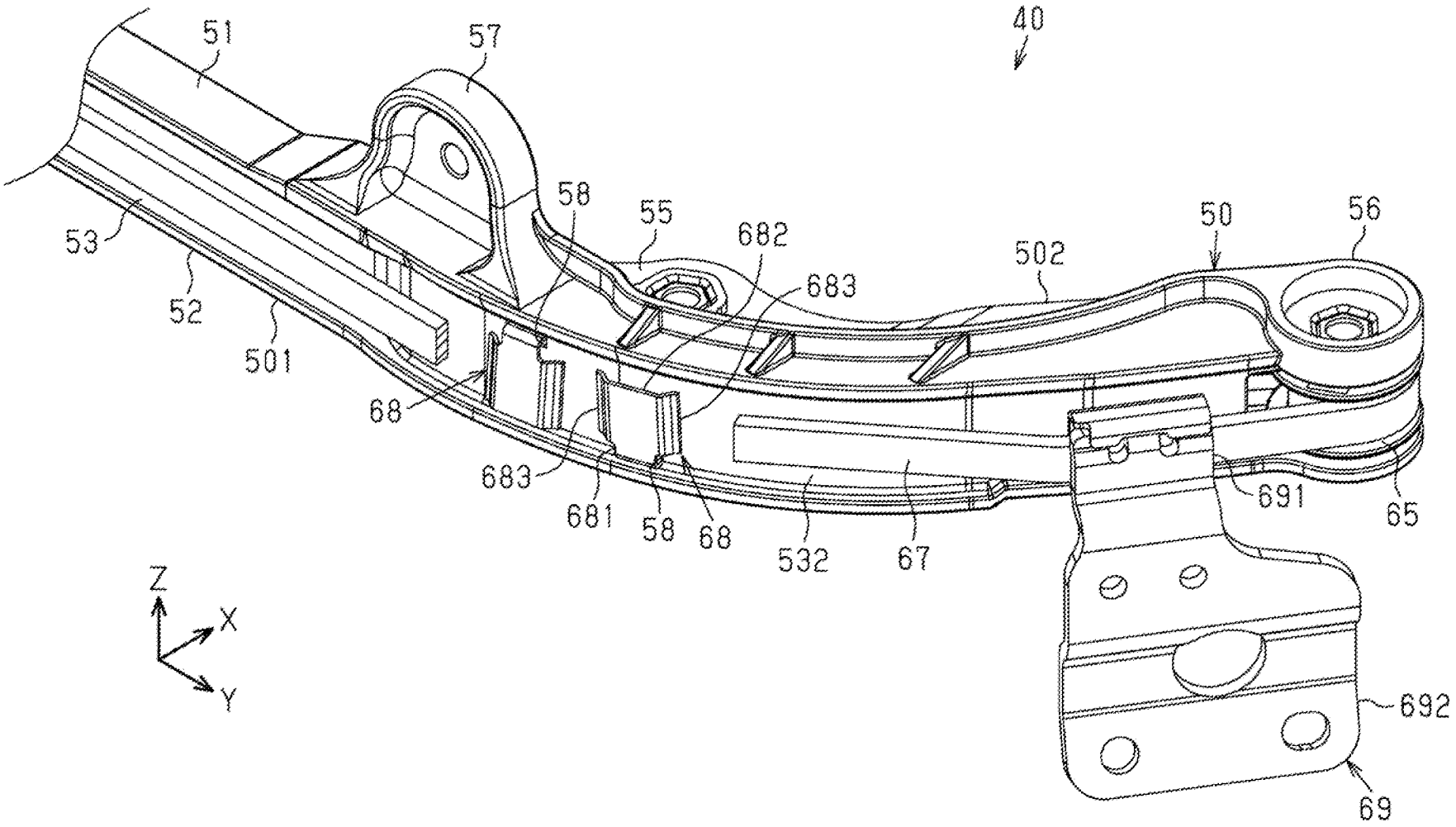
FIG. 6 is an enlarged perspective view of the sliding door drive device.

As shown in FIG. 6, the plural biasing members 68 are arranged next to each other in the longitudinal direction of the belt frame 50 at the positions in the vicinity of the rear end of the second frame 502 of the belt frame 50. In the embodiment, the two biasing members 68 are arranged, however, the number of the biasing members 68 may be changed. The biasing member 68 corresponds to a plate spring made from a curved metal plate.

The biasing member 68 includes a fixing piece 681 (i.e., serving as a fixed end) fixed to the belt frame 50, and a press piece 682 (i.e., serving as a free end) pressing the belt 67 from inward thereof. The fixing piece 681 is fixed to the belt frame 50 by being inserted into the through hole 58 provided at the belt frame 50. The press piece 682 includes curved portions 683 at opposing end portions of the belt frame 50 in the longitudinal direction, the curved portions 683 curved or bent toward the guide wall 53.

The angle of bend of the press piece 682 with respect to the fixing piece 681 is greater than 90 degrees. Thus, in a state where the biasing member 68 is fixed at the belt frame 50, the press piece 682 is separated from the guide wall 53 of the belt frame 50 toward the distal end from the base end. That is, the interval between the base end of the press piece 682 and the guide wall 53 is narrower than the interval between the distal end of the press piece 682 and the guide wall 53. As a result, the press piece 682 easily presses the belt 67 from inward thereof.

In the embodiment, a fixed end is established at a point in which the fixing piece 681 is fixed to the belt frame 50, and a free end is established at a point in which the distal end of the press piece 682 is not fixed to the belt frame 50. Specifically, one of the two biasing members 68 includes a bottom end which is a fixed end while a top end which is a free end, and the other of the two biasing members 68 includes a top end which is a fixed end while a bottom end which is a free end.

The connector 69 includes a sandwiching portion 691 sandwiching the belt 67 in the thickness direction thereof, and a connecting portion 692 connected to the center roller unit 33. The sandwiching portion 691 sandwiches the belt 67 to fix the connector 69 to the belt 67. The sandwiching portion 691 and the connecting portion 692 are members transmitting the power of the door drive device 40 to the sliding door 30 so that it is favorable to be made from a highly elastic material, for example, metals. On the other hand, the sandwiching portion 691 includes a surface facing the guide wall 53 of the belt frame 50, the surface sliding with the biasing member 68 when the belt 67 is driven. Thus, it is favorable that the surface of the sandwiching portion 691 facing the guide wall 53 is coated with resin in order to inhibit metals from being contacted with each other.

The actions of the embodiment will hereunder be explained.

The door drive device 40 opens and closes the sliding door 30, for example, in a case where, a user operates a switch provided at a remote control key, a user seated on a rear seat of the vehicle 10 operates an inside door handle of the sliding door 30, or a user standing a side of the sliding door 30 operates an outside door handle. Specifically, the door drive device 40 drives the belt 67 to move the connector 69 rearward in a case where the sliding door 30 is arranged at the fully-closed position, and frontward in a case where the sliding door 30 is arranged at the fully-open position. In a case where the connector 69 moves rearward, the center roller unit 33 moves rearward to open the sliding door 30, and in a case where the connector 69 moves frontward, the center roller unit 33 moves frontward to close the sliding door 30.

Here, in the embodiment, the belt 67 is wound around the drive pulley 62 in a state where a part thereof is twisted about the axis extending in the circumferential direction of the belt 67. Thus, the door drive device 40 does not require a transmission mechanism at a part where the drive unit 61 and the drive pulley 62 are arranged, the transmission mechanism changing the orientation of the rotary axis.

In a case where the belt 67 is driven, in other words, in a case where the sliding door 30 is operated to be open or closed, the belt 67 slides with the biasing member 68. Now, the opposing end portions of the biasing member 68 in the width direction are curved or bent toward the guide wall 53 of the belt frame 50, it is difficult for large power to be applied to the belt 67. On the other hand, in a case where the belt 67 is not driven, in other words, in a case where the sliding door 30 is stopped, the biasing member 68 biases the belt 67 so that it is difficult for the belt 67 to be loosen.

According to the embodiment, the following effects and advantages may be attained.

In the door drive device 40 of the embodiment, the rotary axis of the drive pulley 62 and each of the rotary axes of the driven pulleys 63 to 65 intersect with each other, and the belt 67 is wound around the drive pulley 62 in a state of being twisted. Thus, even in a case where the rotary axis of the output shaft 612 of the drive unit 61 and the rotary axis of the drive pulley 62 extend in the same direction, a transmission mechanism transmitting the orientation of the rotary shaft of the output shaft 612 of the drive unit 61 does not have to be provided. Thus, the door drive device 40 may transmit the power of the drive unit 61 to the drive pulley 62 with a simple configuration.

The door drive device 40 includes the pair of press pulleys 66 pressing the belt 67 against the drive pulley 62. Thus, the door drive device 40 may easily transmit the power of the drive pulley 62 to the belt 67.

According to the door drive device 40 of the embodiment, the drive unit 61 includes the output shaft 62 and the pair of support shafts 613. Accordingly, the distance between the output shaft 612 and the pair of support shafts 613 may be easily managed. In other words, the door drive device 40 may easily manage the positional relationship between the drive pulley 62 and the press pulleys 66. As a result, the door drive device 40 may easily transmit the power of the drive pulley 62 to the belt 67.

Since the door drive device 40 includes the biasing member 68 pressing the belt from inward of the belt 67, the belt 67 may be easily maintained in the tense state. Thus, the door drive device 40 may inhibit the belt 67 from being loosen irrespective of the position of the sliding door 30. As a result, the door drive device 40 may inhibit noise from being generated by the contact of the belt 67 with respect to the body 20 in a case where wind blows against the belt 67 while the vehicle 10 is moving.

At a point in which the biasing members 68 is a plate spring, the door drive device 40 may include the biasing member 68 with a simple configuration.

The door drive device 40 includes the biasing member 68 which is provided with one of the upper end and the lower end being a fixed end and the other thereof being a free end. Thus, comparing to a configuration where both upper and lower ends of the biasing member 68 are fixed ends, the elastic deformation amount of the biasing member 68 increases. Thus, at a point in which the biasing member 68 is elastically deformable in accordance with the deformation of the belt 67, the door drive device 40 may easily press the belt 67 by the biasing member 68.

In a case where the biasing member 68 is arranged at the first frame 501, the part of the belt 67 against which the biasing member 68 presses may easily come outward in the width direction when the door drive device 40 is mounted on the vehicle 50. According to the door drive device 40, the biasing member 68 is arranged at the second frame 502, and it is difficult for the part of the belt 67 against which the biasing member 68 presses to come outward in the width direction when the door drive device 40 is mounted on the vehicle 50.

In the embodiment, the embodiment may be modified as follows.

The drive unit 61 may be arranged at any position. For example, the drive unit 61 may be arranged such that the drive pulley 62 is arranged between the second driven pulley 64 and the third driven pulley 65 in the circumferential direction of the belt 67.

The support shaft 613 of the drive unit 61 may be arranged at the belt frame 50.

Figure 7:
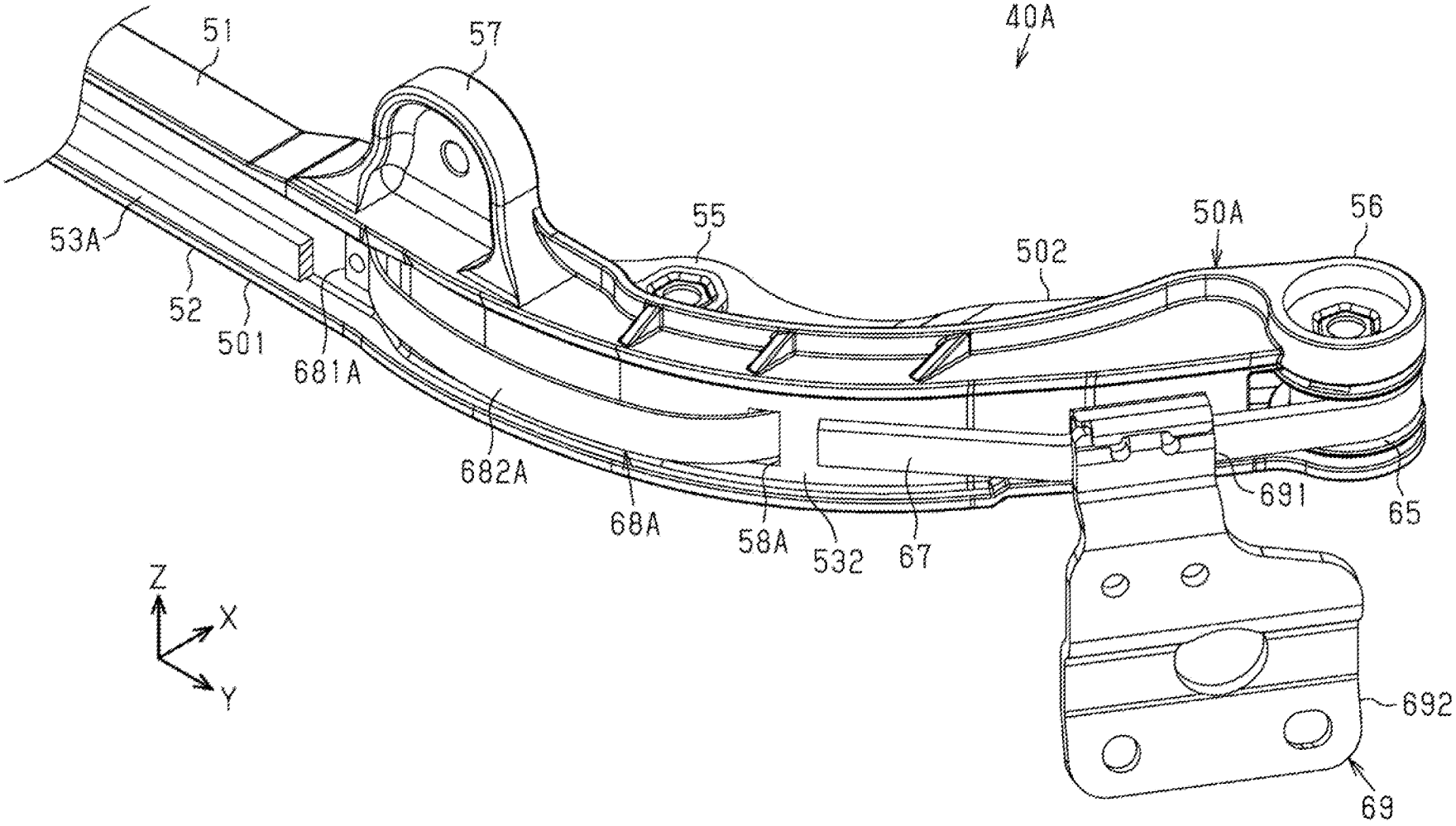
FIG. 7 is an enlarged perspective view of a sliding door drive device of a modified example of the embodiment.

As shown in FIG. 7, the belt frame 50 and the biasing members 68 of the door drive device 40 may be exchanged to a belt frame 50A and a biasing member 68A of a door drive device 40A. A guide wall 53A of the belt frame 50A includes an accommodation hole 58A accommodating the end portion of the biasing member 68A. The accommodation hole 58A is formed in a direction along the width direction when seen in a plan view in the upper-lower direction. The accommodation hole 58A is formed at a position in the vicinity of a middle portion of the second frame 502 in the longitudinal direction. It is favorable that the accommodation hole 58A is formed at an appropriate position in accordance with the dimension or the size of the biasing member 68.

The biasing member 68A is arranged in the vicinity of the rear end of the second frame 502 of the belt frame 50A. In the embodiment, the single biasing member 68A is arranged. Alternatively, the number of the biasing member 68A may be freely changed. The biasing member 68A is a plate spring made from a bent metal plate. The biasing member 68A includes a fixing piece 681A (i.e., serving as a fixed end) fixed to the belt frame 50A, and a press piece 682A (i.e., serving as a free end) pressing the belt 67 from inward. The fixing piece 681A is fixed to the guide wall 53A of the belt frame 50A by a fastener such as a screw. The press piece 682A is curved in an arc shape when seen in a plan view in the upper-lower direction in a state of being fixed to the belt frame 50A. Accordingly, the press piece 682A easily presses the belt 67 from inward. In the embodiment, the fixing piece 681A is a fixed end at a point of being fixed to the belt frame 50A, and the press piece 682A is a free end at a point in which the distal end thereof is not fixed to the belt frame 50A. That is, the biasing member 68A includes the fixed end which is a front end, and the free end which is a rear end. The distal end of the press piece 682A of the biasing member 68A is accommodated in the accommodation hole 58A of the belt frame 50A.

In a case where the biasing member 68A is elastically deformed by the movement of the belt 67, the distal end of the press piece 682A of the biasing member 68A is deeply or shallowly accommodated in the accommodation hole 58A. Thus, the biasing member 68A may press against the belt 67 while being deformed in response to the belt 67. In the door drive device 40A, the free end of the biasing member 68A is inhibited from contacting with the guide wall 53A of the belt frame 50A at a point of being accommodated in the accommodation hole 58A.

The biasing member 68 may be appropriately arranged with respect to the belt frame 50. For example, the biasing member 68 may be arranged at the first frame 501 of the belt frame 50.

The biasing member 68 may be a spring made of resin as long as able to press against the belt 67. The biasing member 68 may be an elastic body made from an elastomer material such as rubber or resin.

The center rail 23 may be arranged inward of the sliding door 30, and the center roller unit 33 may be arranged at the rear end of the door opening portion 21. In this case, it is favorable that the door drive device 40, with the center rail 23, is arranged inward of the sliding door 30.

The door drive device 40 may be arranged at the upper portion of the door opening portion 21, or at the lower portion of the door opening portion 21. That is, the door drive device 40 may drive the sliding door 30 via the upper roller unit 32 or the lower roller unit 34.

The door drive device 40 may be used to drive an opening and closing body of the vehicle 10 other than the sliding door 30. For example, the door drive device 40 may be applied to a window regulator serving as an opening and closing drive device for a vehicle opening and closing a window glass serving as an opening and closing body. The door drive device may also be applied to a sunroof drive device serving as an opening and closing drive device for a vehicle opening and closing a movable panel serving as an opening and closing body.

According to the aforementioned embodiment, the door drive device 40, 40A opening and closing the sliding door 30 of the vehicle 10 includes the belt frame 50, 50A extending in the moving direction of the sliding door 30, the plural driven pulleys 63 to 65 arranged spaced apart from each other in the longitudinal direction of the belt frame 50, 50A, the belt 67 wounded around the plural driven pulleys 63 to 65 and fixed with the connector 69 with respect to the sliding door 30, the drive unit 61 provided with the output shaft 612 including the rotary axis which extends in the different direction from the rotary axis of each of the plural driven pulleys 63 to 65, and the drive pulley 62 connected to the output shaft 612 of the drive unit 61 and configured to drive the belt 67. The drive pulley 62 includes the rotary axis extending in the different direction from the rotary axis of each of the plural driven pulleys 63 to 65 while extending in the same direction as the rotary axis of the output shaft 612. The drive pulley 62 is wound with the belt 67 which is twisted between the driven pulleys 63 to 65 arranged at the opposing sides of the drive pulley 62 in the circumferential direction of the belt.

According to the door drive device 40, 40A of the embodiment, the rotary axis of the drive pulley 62 and each of the rotary axes of the driven pulleys 63 to 65 intersect with each other, and the belt 67 is wound around the drive pulley 62 in a state of being twisted. Thus, even in a case where the rotary axis of the output shaft 612 of the drive unit 61 and the rotary axis of the drive pulley 62 extend in the same direction, a transmission mechanism transmitting the orientation of the rotary shaft of the output shaft 612 of the drive unit 61 does not have to be provided. Thus, the door drive device 40, 40A may transmit the power of the drive unit 61 to the drive pulley 62 with a simple configuration.

According to the aforementioned embodiment, the drive device 40, 40A further includes the press pulley 66 including the rotary axis which extends in the same direction as the rotary axis of the drive pulley 62 and pressing the belt 67 against the drive pulley 62.

According to the aforementioned configuration, the door drive device 40, 40A may easily transmit the power of the drive pulley 62 to the belt 67.

According to the aforementioned embodiment, the press pulley 66 includes the first press pulley 66 and the second press pulley 66 to sandwich the drive pulley 62 therebetween.

Thus, the door drive device 40, 40A may easily transmit the power of the drive pulley 62 to the belt 67.

According to the aforementioned embodiment, the drive unit 61 includes the support shaft 613 supporting the press pulley 66.

According to the door drive device 40, 40A of the embodiment, the drive unit 61 includes the output shaft 62 and the pair of support shafts 613. Accordingly, the distance between the output shaft 612 and the pair of support shafts 613 may be easily managed. In other words, the door drive device 40, 40A may easily manage the positional relationship between the drive pulley 62 and the press pulleys 66. As a result, the door drive device 40 may easily transmit the power of the drive pulley 62 to the belt 67.

According to the aforementioned embodiment, the drive device 40, 40A opens and closes the sliding door 30 serving as the opening and closing body.

According to the aforementioned configuration, the drive device 40,40A may transmit the power of the motor to the timing pulley with a simple configuration.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An opening and closing body drive device for a vehicle opening and closing an opening and closing body of the vehicle, comprising:

a belt frame extending in a moving direction of the opening and closing body;

a plurality of driven pulleys arranged spaced apart from each other in a longitudinal direction of the belt frame;

a belt wounded around the plurality of driven pulleys and fixed with a connector with respect to the opening and closing body;

a drive unit provided with an output shaft including a rotary axis which extends in a different direction from a rotary axis of each of the plurality of driven pulleys;

a drive pulley connected to the output shaft of the drive unit and configured to drive the belt; and a pair of press pulleys including a rotary axis which extends in the same direction as the rotary axis of the drive pulley and pressing the belt against the drive pulley, wherein the drive pulley includes a rotary axis extending in the different direction from the rotary axis of each of the plurality of the driven pulleys while extending in the same direction as the rotary axis of the output shaft, and the drive pulley is wound with the belt which is twisted between the driven pulleys arranged at opposing sides of the pair of press pulleys in a circumferential direction of the belt.

2. The opening and closing body drive device for the vehicle according to claim 1, wherein the pair of press pulleys sandwich the drive pulley therebetween.

3. The opening and closing body drive device for the vehicle according to claim 1, wherein the drive unit includes a pair of support shafts supporting the pair of press pulleys.

4. The opening and closing body drive device for the vehicle according to claim 1, wherein the opening and closing body drive device for the vehicle opens and closes a sliding door serving as the opening and closing body.

5. The opening and closing body drive device for the vehicle according to claim 1, further comprising biasing members provided on the belt frame, the biasing members being elastically deformable with deformation of the belt so as to press the belt.

* * * * *